US006988385B2

(12) United States Patent
Miyamoto

(10) Patent No.: US 6,988,385 B2
(45) Date of Patent: Jan. 24, 2006

(54) YARN FEEDER OF WEFT KNITTING MACHINE AND METHOD OF FEEDING YARN FOR WEFT KNITTING MACHINE

(75) Inventor: Masaki Miyamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 160 days.

(21) Appl. No.: 10/484,462

(22) PCT Filed: Jul. 15, 2002

(86) PCT No.: PCT/JP02/07199

§ 371 (c)(1),
(2), (4) Date: Jan. 22, 2004

(87) PCT Pub. No.: WO03/010378

PCT Pub. Date: Feb. 6, 2003

(65) Prior Publication Data

US 2004/0211224 A1 Oct. 28, 2004

(30) Foreign Application Priority Data

Jul. 24, 2001 (JP) ..... 2001-222495

(51) Int. Cl.
*D04B 15/52* (2006.01)

(52) U.S. Cl. ..... 66/127; 66/126 R

(58) Field of Classification Search ..... 66/125 R, 66/126 R, 127, 128, 129
See application file for complete search history.

(56) References Cited

U.S. PATENT DOCUMENTS

| | | | | |
|---|---|---|---|---|
| 4,513,588 | A | 4/1985 | Lutz | |
| 4,738,124 | A * | 4/1988 | Stoll et al. | 66/127 |
| 5,109,681 | A * | 5/1992 | Schmid et al. | 66/126 R |
| 5,345,789 | A | 9/1994 | Yabuta | |
| 6,021,651 | A * | 2/2000 | Shima | 66/126 A |
| 6,047,570 | A * | 4/2000 | Shima | 66/126 R |
| 6,647,749 | B2 * | 11/2003 | Ikoma | 66/126 A |

OTHER PUBLICATIONS

Microfilm of the specification and drawings annexed to the request of Japanese Utility Model Application No. 43250/1980 (Laid-open No. 140139/1981).

* cited by examiner

*Primary Examiner*—Danny Worrell
(74) *Attorney, Agent, or Firm*—Wenderoth, Lind & Ponack, L.L.P.

(57) ABSTRACT

A switching mechanism is provided for switching the position of a yarn feeding mouth to another and swinging a yarn feeder. The switching mechanism includes a push operating portion for changing a swing direction of the yarn feeding mouth and a height position thereof in cooperation with a leading means until a yarn feeder selected by the leading means feeds a yarn and is led from a stopped state. The push operating portion forms a lowering surface in a surface of the push operating portion. The lowering surface is used to further lower the yarn feeding mouth from a yarn feeding position so as to allow the yarn to pass under a backface side of the needle.

2 Claims, 12 Drawing Sheets

YARN FEEDER OF WEFT KNITTING MACHINE AND METHOD OF FEEDING YARN FOR WEFT KNITTING MACHINE

TECHNICAL FIELD

This invention relates to a yarn feeding device used chiefly for intarsia knitting and a yarn feeding method of a portion where knitting yarns are changed.

BACKGROUND ART

An intarsia fabric is formed by performing a knitting operation with different knitting yarns without separating a knitted fabric while performing switching among several yarn feeders during a 1-course knitting operation.

In this intarsia knitting operation, a plurality of yarn feeders 12*a* and 12*b* are slidably disposed in a yarn guide rail as shown in FIG. 12. Yarns are fed to knit a first knitting area A by means of the yarn feeder 12*a* and to knit a second knitting area B by means of the yarn feeder 12*b*, and switching is performed from the yarn feeder 12*a* to the yarn feeder 12*b* at a switching point where a yarn is changed to another. When the yarn feeder 12*a* finishes feeding a yarn to the leftmost needle among needles used to knit the knitting area A from the right, the yarn feeder 12*a* has already been positioned left beyond a fabric boundary position P1 (i.e., a state shown by the alternate long and two short dashed line in the figure).

The reason why the yarn feeder moves beyond the boundary position P1 in this way is to allow the yarn feeder to travel ahead of the needle forming a loop so as to lower the position of a knitting yarn that extends from the yarn feeder to the knitted fabric and so as to reliably catch the yarn in a hook of the needle.

If the yarn feeder 12*a* is left at that position, the trouble arises in which a knitting yarn T that extends from the yarn feeder 12*a* diagonally right-downward is fed to a knitting needle that knits the subsequent second knitting area B by mistake.

Therefore, in order to eliminate this trouble, a yarn is fed from a feeding mouth of a yarn feeder selected by a leading means, a yarn feeder that is knitting, for example, the knitting area A is then released from being led at a boundary position of a knitted fabric, and the yarn feeder is stopped by a braking device.

When the leading means is further slid while the yarn feeder is being stopped by the braking device, the feeding mouth of the yarn feeder is moved from the yarn feeding position to a standby position placed inside the knitting area where knitting has been performed so far. According to this method, it becomes possible to prevent trouble in which a yarn is incorrectly fed to a needle used for the adjoining knitting area (see Japanese Patent Publication No. Sho-61-51061, for example).

The position of a yarn is lowered proportionately as the yarn feeder greatly moves beyond the boundary with the adjoining knitting area, and, as a result, a yarn feeding condition can be improved. However, since the feeding mouth is released from the leading means at a position exceeding the boundary with the adjoining knitting area, the amount of swing of the yarn feeder 12*a* must be increased correspondingly to the amount necessitated to retract a yarn extending between the yarn feeder 12*a* that has stopped inside the adjoining area A and the knitted fabric to a position that does not obstruct the operation of knitting the area B.

If the amount of swing of the yarn feeder 12*a* is increased, a swinging mechanism of the yarn feeder is enlarged and complicated.

When the yarn feeder is changed from the yarn feeding position to the standby position placed inside the knitting area, the amount of swing of the yarn feeder needed for a change from the yarn feeding position to the standby position is increased in a gauge in which a fabric is rough or in a needle-jumping-over knitting operation in which a knitting operation is performed by disposing a blank needle for transfer between needles used to form a loop as disclosed in Japanese Patent Application No. Hei-11-111717. Therefore, there is a fear that a knitting yarn will snap if the yarn is fragile.

On the other hand, when a yarn is changed to another, fabrics must be joined together according to a so-called "tuck joint" at the fabric boundary in which a tucking operation is performed with a needle used in the adjoining knitting area, and a subsequent knitting course is formed before switching is performed between yarn feeders so that a newly selected yarn feeder starts feeding a yarn.

The "tuck joint" will be described with reference to FIG. 3.

FIG. 3 shows a tuck joint at the boundary between the knitting area A and the knitting area B of FIG. 12 in which an alternate long and short dashed line represents the boundary therebetween.

A needle 5*a* is the leftmost one in the knitting area A, and a needle 5*b* is the rightmost one in the knitting area B. A yarn feeder is moved from the left to the right in FIG. 3. After a loop is formed with the rightmost needle 5*b* in the knitting area B, leading is released, and the yarn feeder is swung to a standby position shown by the alternate long and short dashed line.

Thereafter, the knitting area A is knitted by another yarn feeder, not shown, from the left to the right, is then knitted from right to left in a subsequent course, and the yarn feeder is swung to the standby position in the same way as a yarn feeder used to knit the area B.

Thereafter, a tuck joint is performed in the knitting area A by means of the yarn feeder used for the knitting area B when the knitting area B is knitted from right to left.

FIG. 3 shows a needle-jumping-over knitting operation in which a loop is formed with every second needle. Therefore, the tuck joint of the knitting area B is performed with a knitting needle 5*c*, jumping over the needle 5*a* adjoining to the fabric boundary.

In a course in which the area B is knitted from right to left, the yarn feeder is swung from the standby position to an upright position shown by a solid line. After that, the needle 5*c* used for a tucking operation is raised, the yarn feeder is then moved from right to left, and a knitting yarn slid toward the backface of the needle is fed toward the surface of the needle 5*c*.

There has been a fear that the yarn will not turn to the backface of the needle 5*c* so that the needle 5*c* fails to catch the yarn when the needle 5*c* used for a tucking operation is raised in the vicinity of the yarn feeder.

Thus, if the needle 5*c* for a tucking operation is placed far from the fabric boundary, the yarn feeder must be greatly swung, and, disadvantageously, the yarn feeder is enlarged.

A description has been made of a case in which a needle-jumping-over knitting operation is performed as shown in FIG. 3. However, even in a with-all-needle knitting operation in which a knitting operation is performed without disposing the blank needle between the needles used to form a loop, the same problem as in the needle-jumping-over knitting operation arises because a tucking operation is performed with a needle situated outside the needle 5*c*, for example, if a knitting width of the area B is increased rightward to the extent corresponding to one needle so that the needle 5*a* can be used for the area B.

Additionally, since a flat knitting machine of a rough gauge has a large interval between needles, the aforementioned problem may occur even if the needle-jumping-over knitting operation or the width-increasing knitting operation is not performed.

The present invention has been proposed in consideration of the aforementioned problems. It is therefore an object of the present invention to provide a yarn feeding device of a flat knitting machine capable of obtaining the same effect as in a case in which the amount of swing of a yarn feeder is substantially increased without increasing the amount thereof and to provide a yarn feeding method thereof.

DISCLOSURE OF THE INVENTION

In order to achieve the object, a yarn feeding device of a flat knitting machine according to the present invention is characterized in that the yarn feeding device includes a feeder case a part of which is slidably engaged with a yarn guide rail disposed on an upper part of a needle bed and a slide driving mechanism by which a yarn feeder selected from among a plurality of yarn feeders by a leading means is led, wherein the feeder case includes a switching mechanism for switching a position of a yarn feeding mouth to another and swinging the yarn feeder, and the switching mechanism includes a push operating portion for changing a swing direction of the yarn feeding mouth and a height position thereof in cooperation with the leading means, and the push operating portion forms a lowering surface used to further lower the yarn feeding mouth from a yarn feeding position in a surface of the push operating portion, and, until the yarn feeder selected by the leading means feeds a yarn and is led from a stopped state, the yarn feeding mouth is lowered from a standby position to a descent position and is raised to the yarn feeding position after a knitting yarn is caused to pass under a backface side of a knitting needle.

A yarn feeding method of a flat knitting machine according to the present invention is characterized in that a feeder case part is slidably engaged with a yarn guide rail disposed on an upper part of a needle bed and is selectively led by a leading means, and, until a yarn feeder selected to switch a knitting yarn to another is caused to feed a yarn and is traveled from a standby position where the yarn feeder is stopped, a yarn feeding mouth is swung from the standby position to a yarn feeding position in a state of stopping the yarn feeder and is then lowered to a descent position for a tuck placed below the yarn feeding position, and, by advancing an outer knitting needle adjoining to a knitting area knitted by the selected yarn feeder, a knitting yarn fed from the yarn feeding mouth of the yarn feeder occupying the descent position is caused to pass under an undersurface of the advanced knitting needle, and the yarn feeder is then raised, and, with the yarn feeding mouth as a yarn feeding position, the selected yarn feeder is caused to feed a knitting yarn and is traveled with a slide driving means by the leading means.

BEST MODE FOR CARRYING OUT THE INVENTION

With reference to the attached drawings, a description will be hereinafter given of an embodiment of a yarn feeding device of a flat knitting machine and a yarn feeding method of a flat knitting machine according to the present invention.

Figure 1:
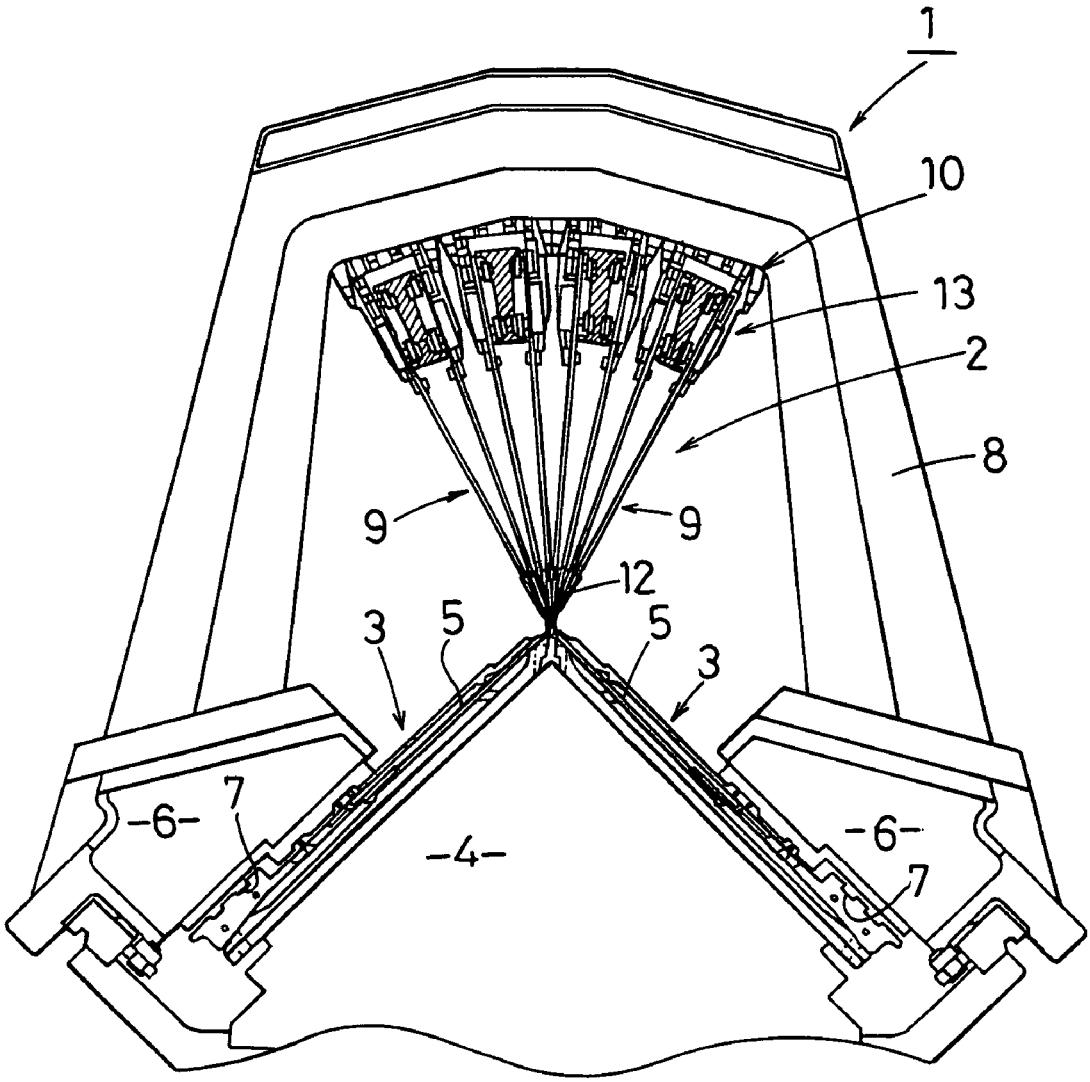
FIG. 1 is a side view of a flat knitting machine that has a yarn feeding device including a yarn feeder of the present invention.

FIG. 1 is a side view of a flat knitting machine that has a yarn feeding device including a yarn feeder of the present invention, in which reference numeral 1 designates the flat knitting machine shown almost entirely, and reference numeral 2 designates the yarn feeding device.

The flat knitting machine 1 is disposed in a frame 4 in which a pair of front and back needle beds 3 are placed in the shape of "A" with their tips facing each other. The needle beds 3 each have a plurality of knitting needles 5 arranged side by side so that they can be controlled and moved back and forth.

A carriage 6 is disposed on the upper surface of the needle bed 3 so that it can be reciprocated by a belt-drive means (not shown). The carriage 6 has a knitting cam 7 as shown in the figure. The needle 5 is moved back and forth by operating a butt 48 of the needle 5 by means of the knitting cam 7.

The carriage 6 is provided with a gate arm 8 unitedly connected astride the front and back needle beds 3. A leading means 10 for leading a yarn feeder 9 and a depressing means 13 for lowering a yarn feeding mouth 12 of the yarn feeder 9 to a position in the vicinity of the tips of the knitting needles 5 and 5 are mounted on the gate arm (i.e., slide driving mechanism) 8.

Centering on a position in the vicinity of the tips of the needles 5 arranged side by side on the needle bed 3, four yarn guide rails 11 are disposed along a longitudinal direction of the needle bed 3 like a fan in forward and backward directions of the needle bed 3 above the needle bed 3.

Figure 2:
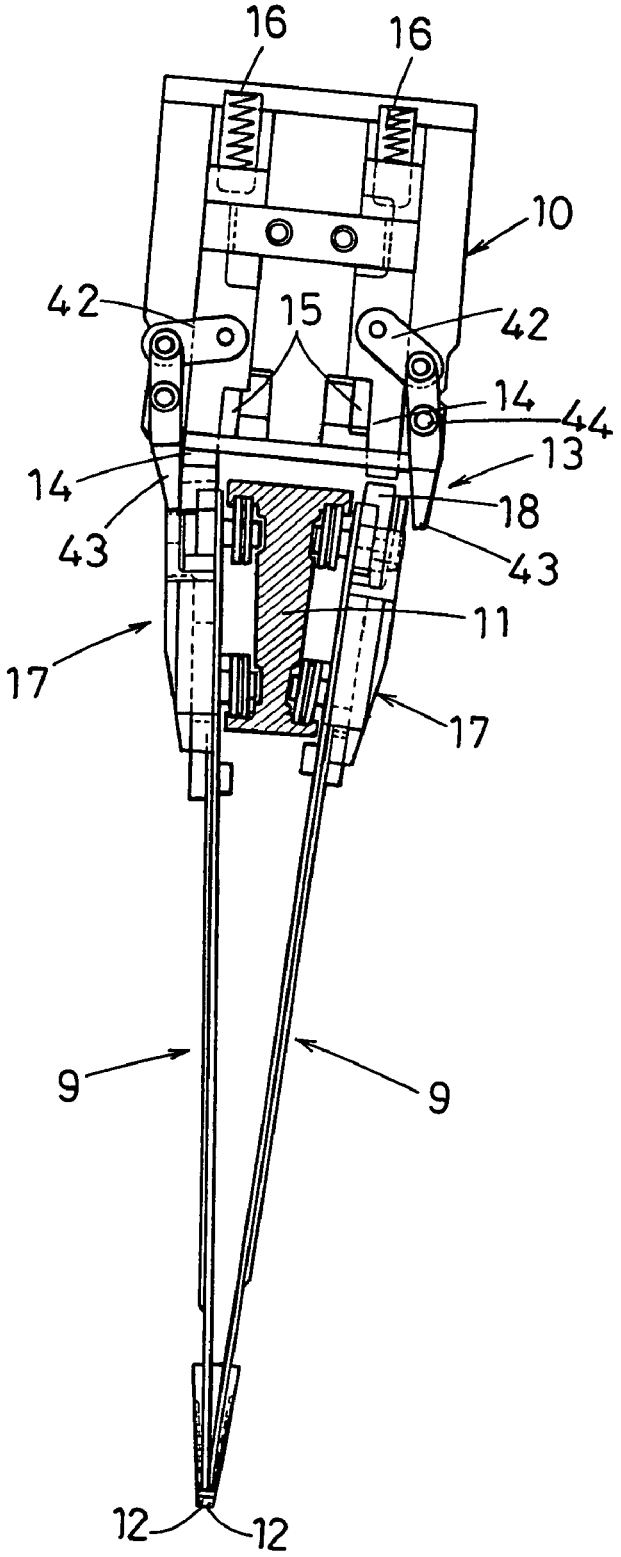
FIG. 2 is an enlarged view of a part of the yarn feeder of the present invention.

The leading means 10 has a transmission rod 15 used to transmit the motion of an output shaft of a solenoid, which is controlled to be projected and retracted, to a leading pin 14 by an output signal emitted from a controller (not shown) as shown in FIG. 2. The leading pin 14 is urged to be lowered by a spring 16. The yarn feeder 9 is led while engaging the leading pin 14 with engagement portions 19 formed on a pair of right and left swing pieces 18 at the upper, middle part of a feeder case 17 of each of the yarn feeders 9 (see FIG. 3).

The yarn feeder 9 is formed by drooping the feeder case 17 swingably supported by the yarn guide rails 11, a yarn feeding rod 20 that has the yarn feeding mouth 12 at the lower end from the feeder case 17, and a yarn feeding rod guide 21 that guides the yarn feeding rod 20 in the upward and downward directions. The yarn feeding rod guide 21 is swingably pivoted on the feeder case 17 at a pivot part of its upper part.

The yarn feeding rod 20 is made up of a slender, planar lower plate 22 whose right and left side edges are supported by the yarn feeding rod guide 21 so that they can be raised, lowered, and slid, an intermediate plate 23 whose lower end is joined to the upper end of the lower plate 22, and an upper plate 25 whose lower end is connected through a depressing roller 24 projected to the rear side of the upper part of the intermediate plate 23. The depressing roller 24 is fitted into an oblong hole 26 formed in the lower end of the upper plate 25.

A coil spring 27 used to raise and urge the yarn feeding mouth 12 is mounted between spring receiving portions 28 of the feeder case 17 through the intermediate plate 23 and the lower plate 22 in the middle of the upper plate 25.

A switching roller 30 of the switching mechanism 29 that switches the posture of the yarn feeding mouth 12 is projected from the front surface of the upper end of the intermediate plate 23.

The switching mechanism 29 is made up of the switching roller 30, a restriction hole 31 bored in the feeder case 17 to restrict the swing of the switching roller 30, and a selecting lever 32 provided on the rear side of the restriction hole 31.

Figure 3:
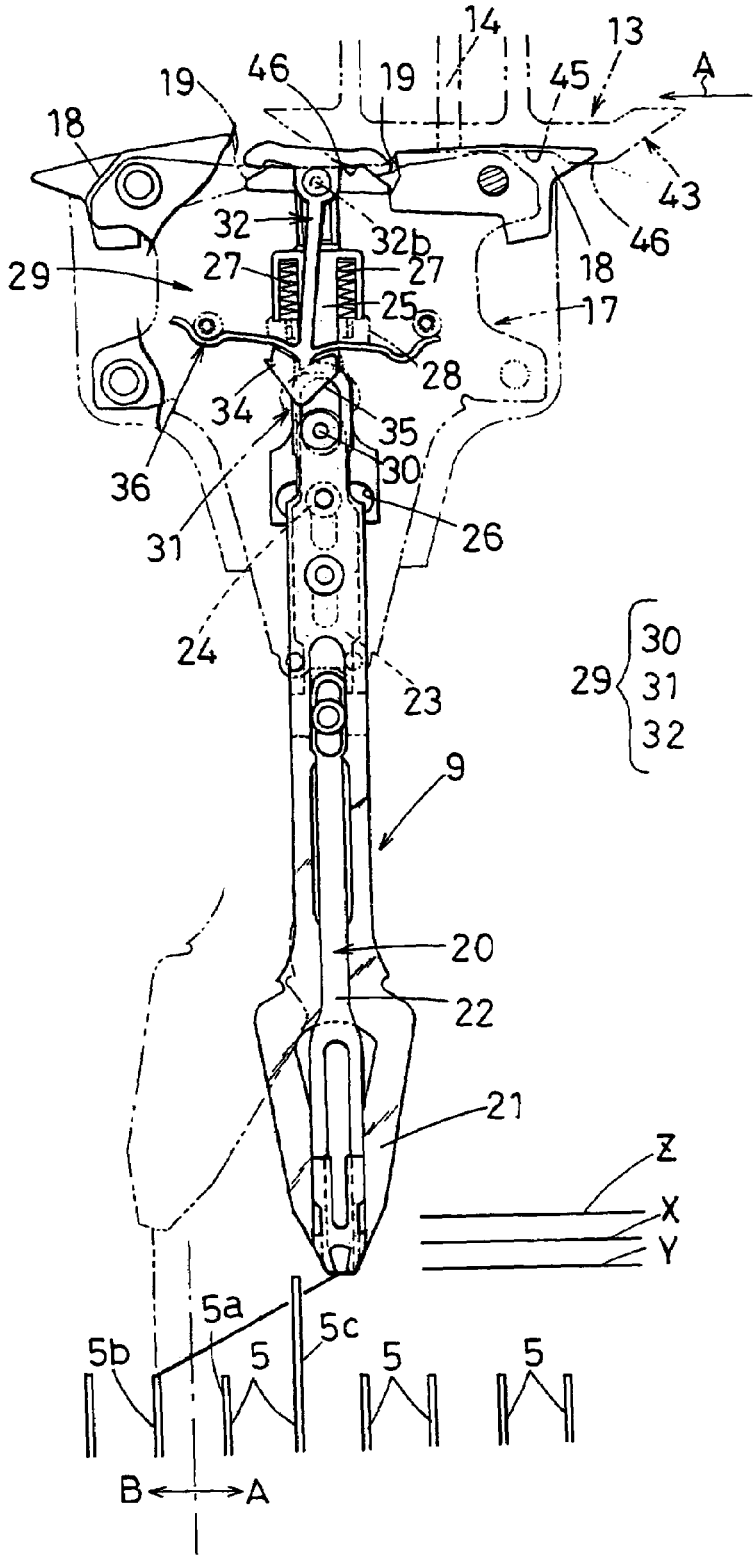
FIG. 3 is an explanatory drawing of a part of the yarn feeder of the present invention.
Figure 4:
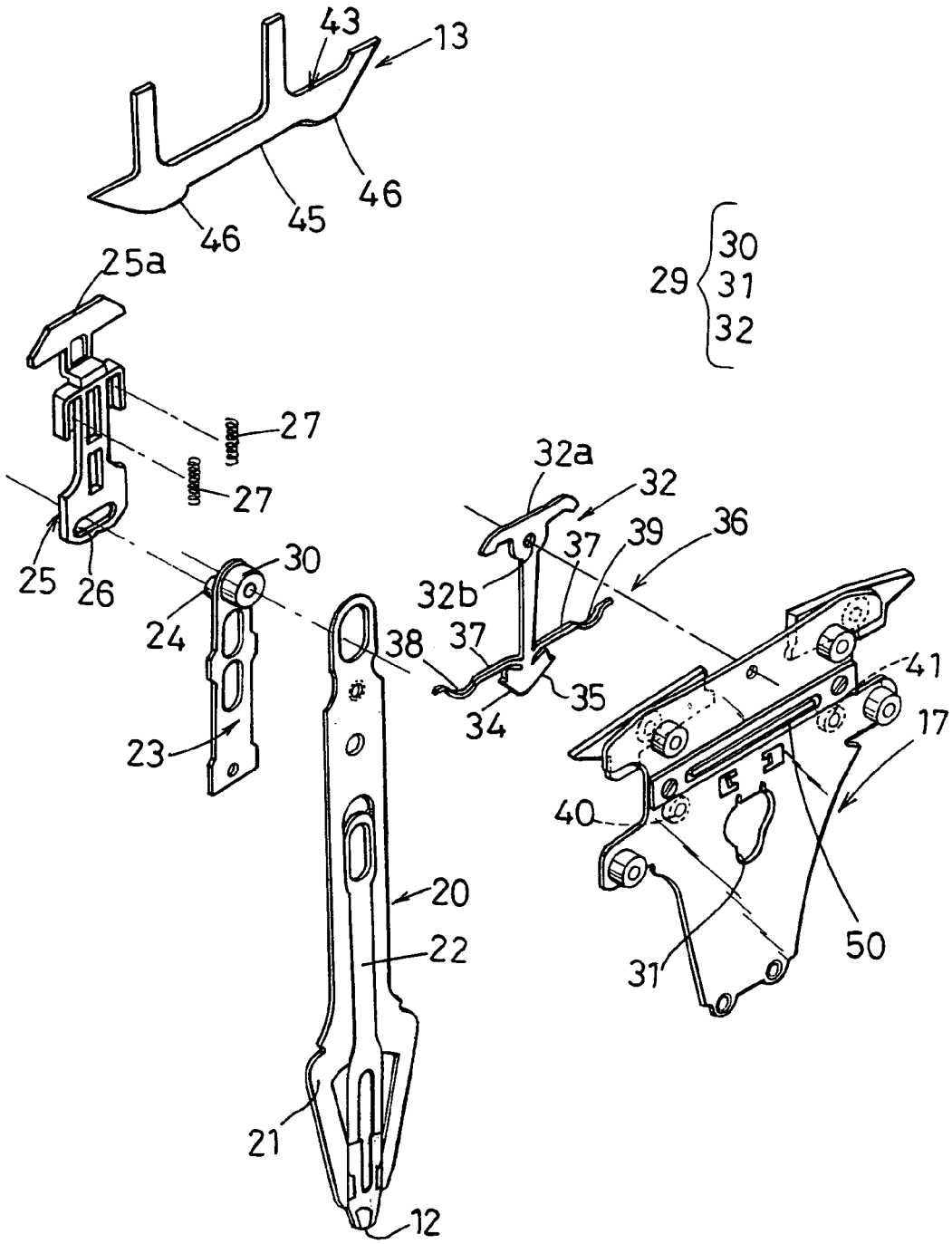
FIG. 4 is an exploded perspective view of a part of the yarn feeder of the present invention.

As shown in FIG. 3 and FIG. 4, the restriction hole 31 has a nearly trefoil shape that has parts into which the switching roller 30 is fitted at its center and at the right and left of its upper part.

The selecting lever 32 that determines the upward direction of the switching roller 30 facing the restriction hole 31 is shaped almost like a "T," and its upper end 32*a* has a gentle "V" shape. A pivot part 32*b* provided at the middle thereof is pivoted on the feeder case 17. In order to distribute the upward direction of the switching roller 30, the lower end drooped from the center part of the upper end 32*a* is shaped like an arrow that has inclined faces 34 and 35 at the left and right thereof, respectively.

A maintaining means 36 for maintaining the switching posture of the selecting lever 32 is provided on the upper part of the arrow that has the two inclined faces 34 and 35.

The maintaining means 36 is made up of an elastic part 37 extending rightward and leftward from the upper part of the arrow like a mustache, holding parts 38 and 39 formed by bending parts near the ends of the elastic part 37, and engagement projections 40 and 41 that are formed on the backface of the feeder case 17 and that are fitted to one of the holding parts 38 and 39 when the selecting lever 32 is operated and swung rightward or leftward.

The depressing means 13 that depresses the yarn feeding rod 20 is formed so that a cam plate 43 is swung back and forth centering on a swing pivot pin 44 in response to the up-and-down movement of the leading pin 14 by means of a connection plate 42 whose one end is connected to the intermediate height position of the leading pin 14 and whose other end is connected to the upper end of the cam plate 43.

As shown in FIG. 4, the cam plate 43 has a flat cam surface 45 for a yarn feeding position formed at a part near the center of the undersurface thereof and cam surfaces 46 for a tuck formed by projecting undersurface parts near its ends downward. The leading pin 14 is provided on the side of the yarn guide rail 11 at a central position of a flat lower edge of the cam plate 43.

In FIG. 4, a braking device designated by reference numeral 50 is formed with magnets that adhere to the yarn guide rail. If the yarn feeder 9 is reduced in size and weight, the yarn feeder 9 can be stopped at an exact position even by light swing friction generated by an attracting force of the magnets.

Therefore, unlike a conventional yarn feeder, a disadvantageous case does not occur in which the position of a yarn feeder to be stopped becomes unstable because of great inertia force, so that the yarn feeder cannot be stopped at a desired position when the yarn feeder being led is stopped. Additionally, it is possible to eliminate the necessity to provide a special braking device to stop a yarn feeder at a desired stop position while overcoming a great inertia force.

Next, a description will be given of the operation of the yarn feeding device in knitting an intarsia fabric.

Figure 12:
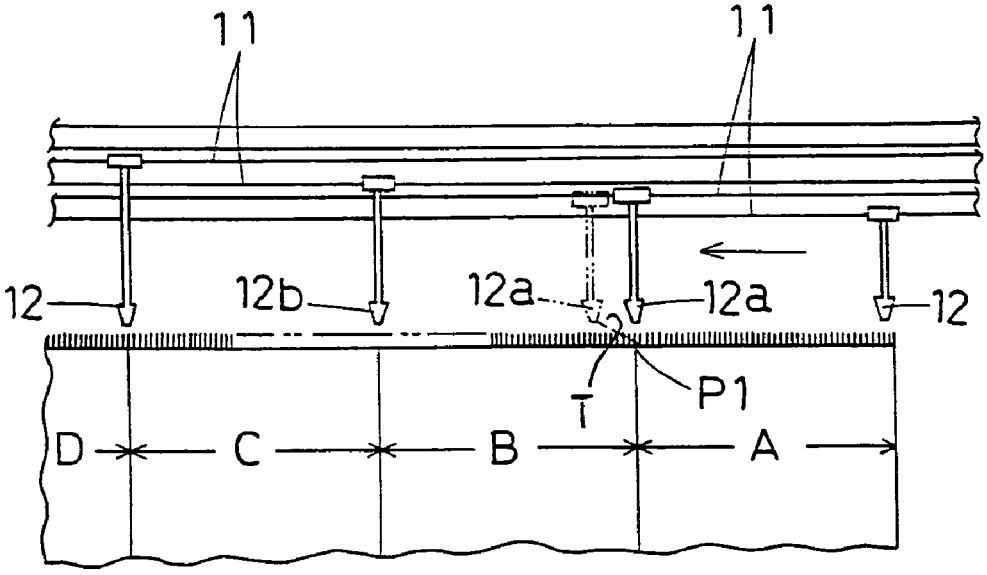
FIG. 12 is an explanatory drawing of a knitting course in a conventional intarsia knitting operation.

In this embodiment, a flat knitting machine is used in which two cam units are formed by allowing the phase to differ in the moving direction of the carriage, and a description will be given of a knitting operation performed at the boundary between the knitting area A and the knitting area B, taking an example in which, like the knitted fabric of FIG. 12, the right knitting area A is knitted by a preceding cam unit whereas the left knitting area B is knitted by a subsequent cam unit according to needle-jumping-over knitting.

When the carriage 6 travels on the upper surface of the needle bed 3 from right to left (i.e., in a direction indicated by A of FIG. 3 and FIG. 5) by the belt-drive means according to an output signal of the controller, the knitting needles 5 arranged side by side on the needle bed 3 are advanced and retracted by the knitting cam 7.

When the carriage 6 is traveling, in an area where a knitting operation is not performed, the solenoid is actuated by an output signal used for pattern knitting, and the output shaft is projected downward, and the leading pin 14 of the leading means 10 is raised through the transmission rod 15 while resisting the tension of the spring 16.

In response to a rise in the leading pin 14, the cam plate 43 of the depressing means 13 is sprung centering on the swing pivot pin 44 (see the cam plate 43 shown at the right of FIG. 2).

In an area where a knitting operation is performed, the solenoid is actuated according to an output signal of the controller before a position where the carriage 6 faces a predetermined yarn feeder 9 by which a knitting yarn is fed, and, when its output shaft is retracted upward, the leading pin 14 that has been raised is lowered by the tension of the spring 16. In conjunction with the depression of the leading pin 14, the cam plate 43 of the depressing means 13 is swung toward the yarn feeder 9 centering on the swing pivot pin 44 through the connection plate 42 (see the cam plate shown at the left of FIG. 2).

Figure 5:
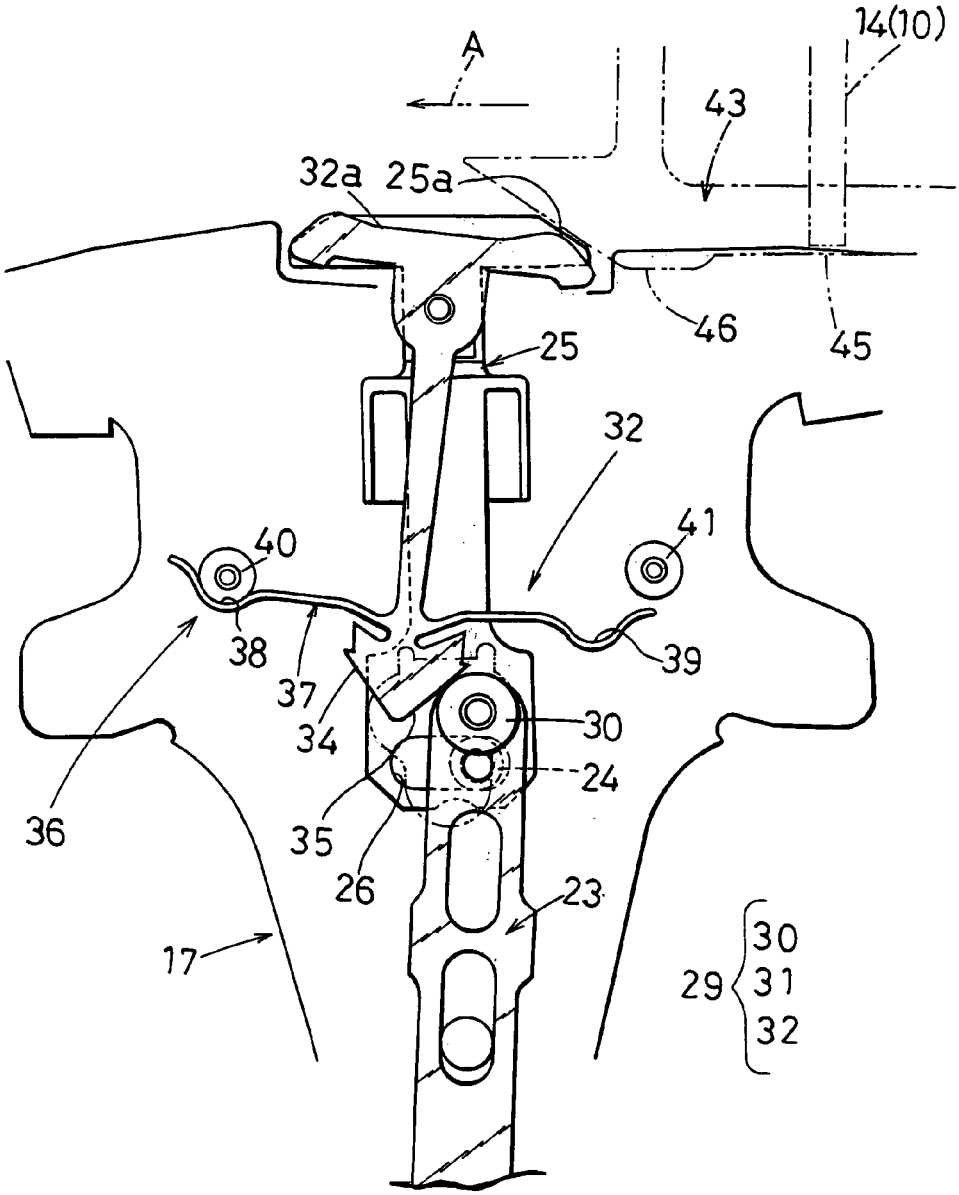
FIG. 5 is an operation explanatory drawing of a selecting lever part in the yarn feeder of the present invention.
Figure 6:
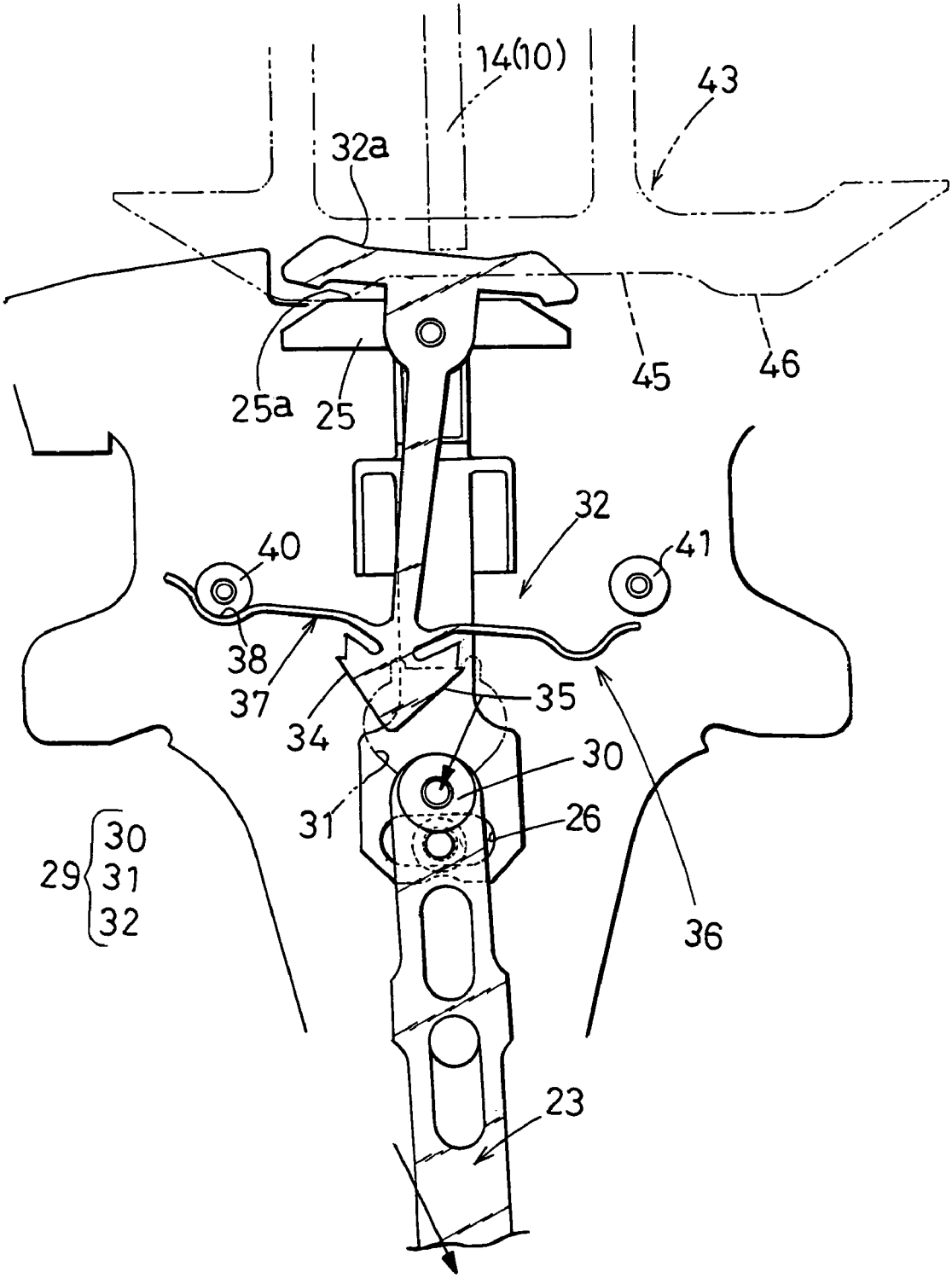
FIG. 6 is an operation explanatory drawing of the selecting lever part in the yarn feeder of the present invention.

When the carriage 6 is slid, and the cam plate 43 depresses the upper end 25*a* of the upper plate 25 at the inclined part of its end while resisting an urging force of the coil spring 27, the switching roller 30 facing the restriction hole 31 is guided from the state of FIG. 5 to the lower center part of the restriction hole 31 and reaches the depressed state of FIG. 6.

In response to the descent of the switching roller 30 being guided by the lower center part of the restriction hole 31, the yarn feeding rod guide 21 is erected at the center part of the feeder case 17 while projecting the yarn feeding mouth 12 of the yarn feeding rod 20 from the lower end of the rod guide 21 downward, and the yarn feeding mouth 12 reaches the state of the yarn feeding position close to the knitting needle of the needle bed 3.

Figure 7:
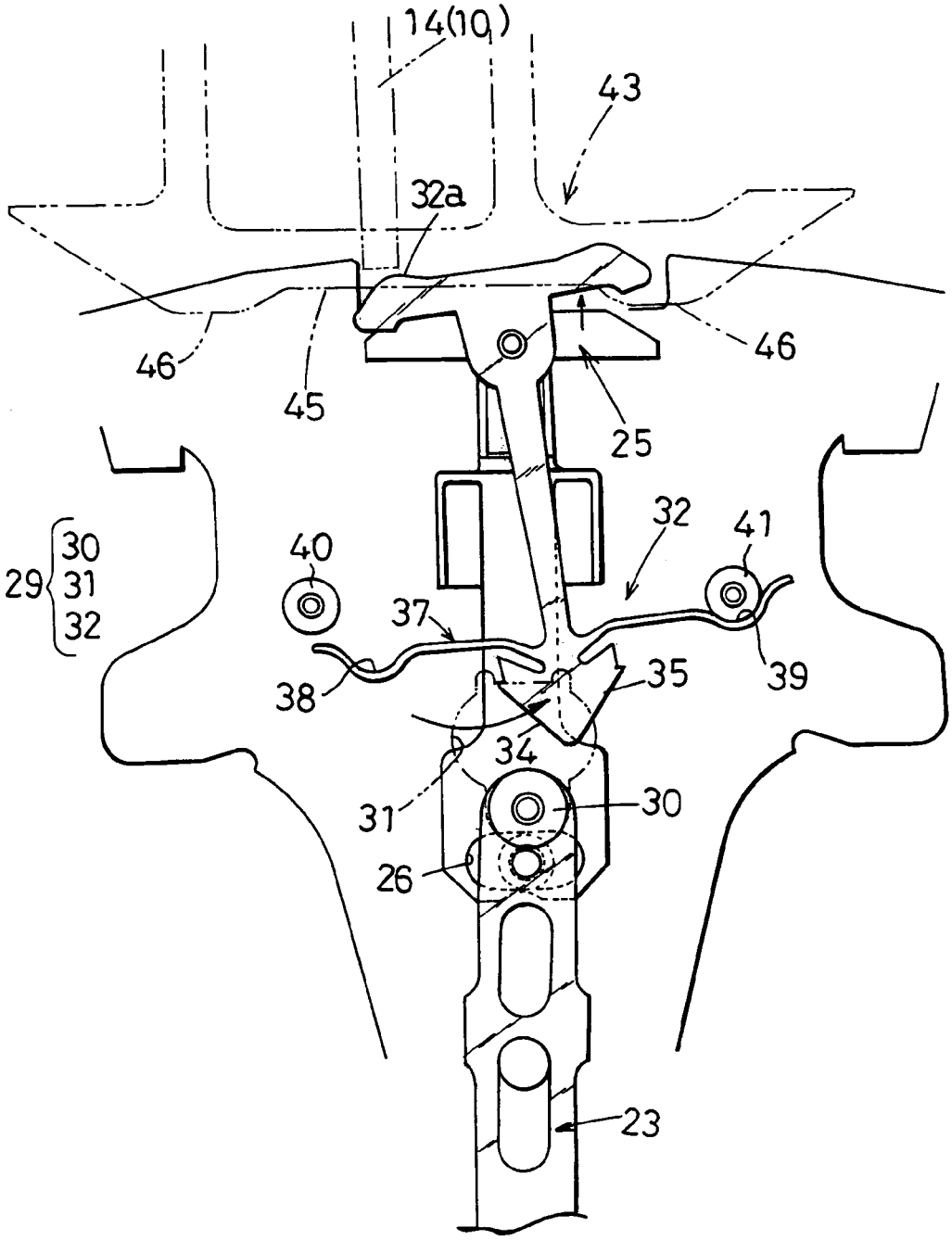
FIG. 7 is an operation explanatory drawing of the selecting lever part in the yarn feeder of the present invention.

When the leading pin 14 stops the upper end 32*a* on the protruding lower part side (left side) of the selecting lever 32 by a further movement of the carriage 6 leftward, the selecting lever 32 is swung counterclockwise with the pivot part 32*b* as a rotational center as shown in FIG. 7. This posture is maintained by breaking an engagement between the left holding part 38 of the elastic part 37 forming the maintaining means 36 and the engagement projection 40 and by making an engagement between the right holding part 39 and the engagement projection 41.

After that, when the leading pin 14 comes in contact with the engagement portion 19 of the swing piece 18 that is situated on the downstream side in the traveling direction of the selecting lever 32, the yarn feeder 9 is brought into the state of being led by the carriage 6. Accordingly, a knitting yarn is fed from the yarn feeding mouth 12 of the yarn feeder 9 to the needle 5, and the knitting area A is knitted with the yarn fed from the yarn feeder 9.

When the knitting operation of the area A is completed, electricity is supplied to the solenoid according to an output signal of the controller, and the output shaft of the solenoid is projected downward, so that the leading pin 14 that has been lowered is pushed up against the tension of the spring 16. In response to a rise in the leading pin 14, the cam plate 43 of the depressing means 13 is swung centering on the swing pivot pin 44 while being sprung.

When an engagement with the engagement portion 19 of the swing piece 18 located on the downstream side in the traveling direction of the carriage 6 is broken by the rise of the leading pin 14, the yarn feeder 9 is released. At the same time, as a result of the jumping up and swinging of the cam plate 43, the yarn feeding rod 20 that has been lowered so far is pushed up by the coil spring 27 to a position where the yarn feeding mouth 12 at the lower end does not interfere with the yarn feeding mouth 12 of another yarn feeder 9 or with the needle 5 or a sinker.

Figure 8:
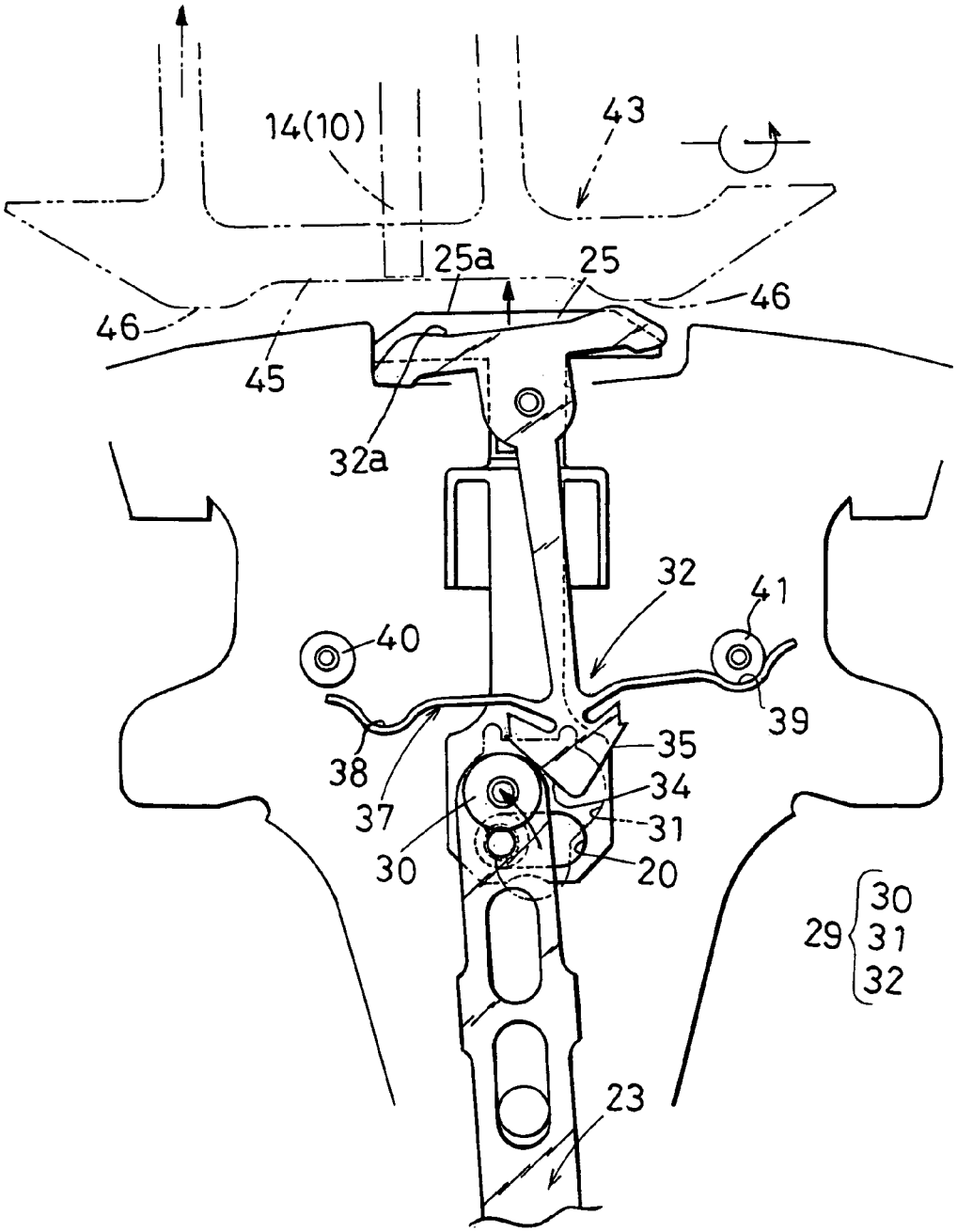
FIG. 8 is an operation explanatory drawing of the selecting lever part in the yarn feeder of the present invention.

When the yarn feeding rod 20 is pushed up by the coil spring 27 and when the switching roller 30 is raised, the switching roller 30 is raised in the upper left direction while being guided by the left inclined face 34 as shown in FIG. 8 because the selecting lever 32 has already been switched counterclockwise. As a result, the yarn feeding mouth 12 is raised together with the yarn feeding rod guide 21 while being swung rightward.

Thereafter, when the carriage 6 is further moved leftward and reaches the position where the knitting area B is knitted by the subsequent cam unit, the same operation as above is performed with respect to a yarn feeder 9 used to knit the knitting area B. At this time, the yarn feeder 9 is stopped at the fabric boundary in the knitting area A at the end of the knitting operation in the previous course, and then the yarn feeder 9 is in the state of having been swung to the left. The solenoid is actuated according to an output signal of the controller, and the output shaft thereof is retracted upward, so that the leading pin 14 that has been raised is lowered by the tension of the spring 27, and the cam plate 43 of the depressing means 13 is swung toward the yarn feeder 9 centering on the swing pivot pin 44.

Figure 9:
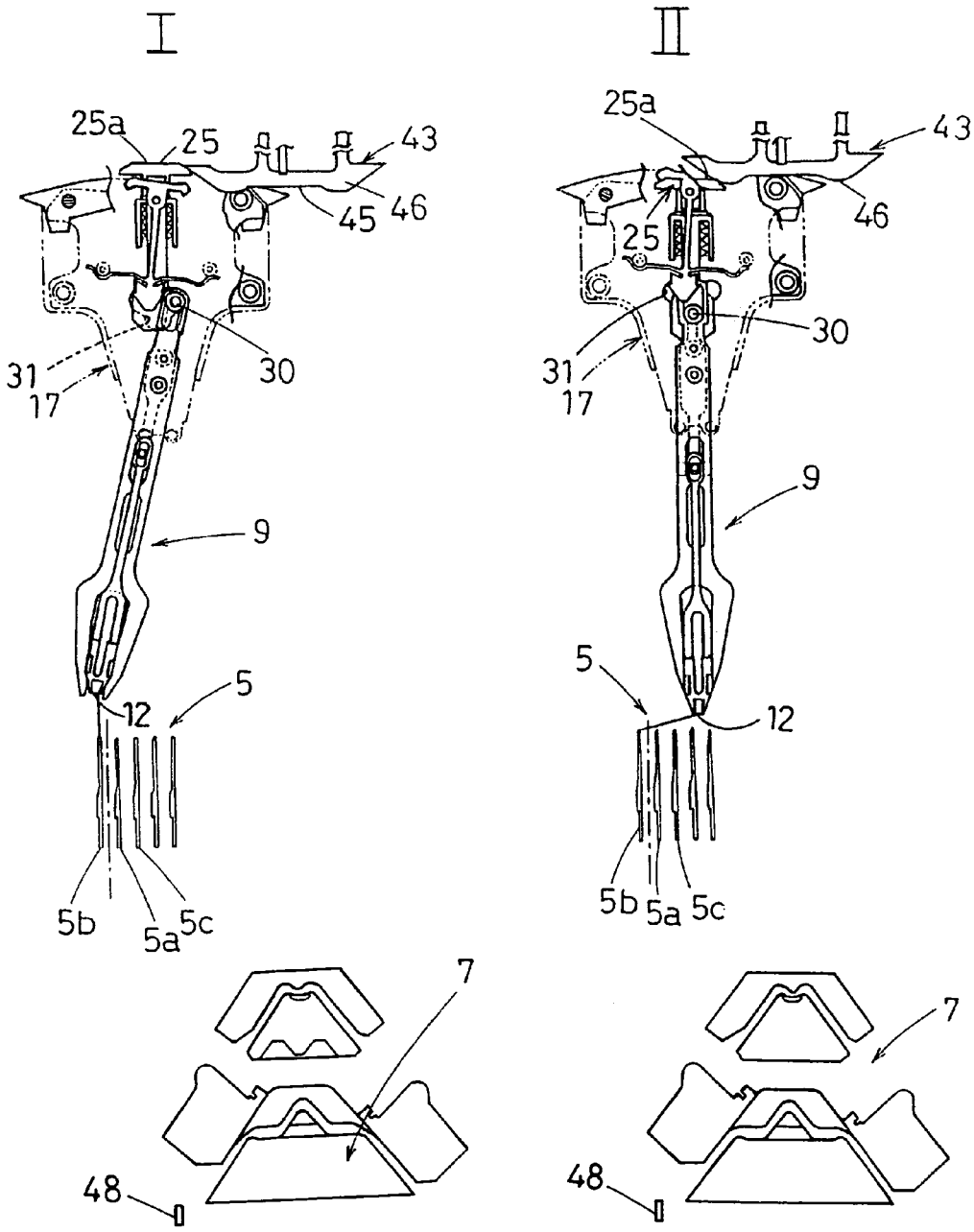
FIG. 9 is an operation explanatory drawing of a tuck joint in the yarn feeder of the present invention.
Figure 10:
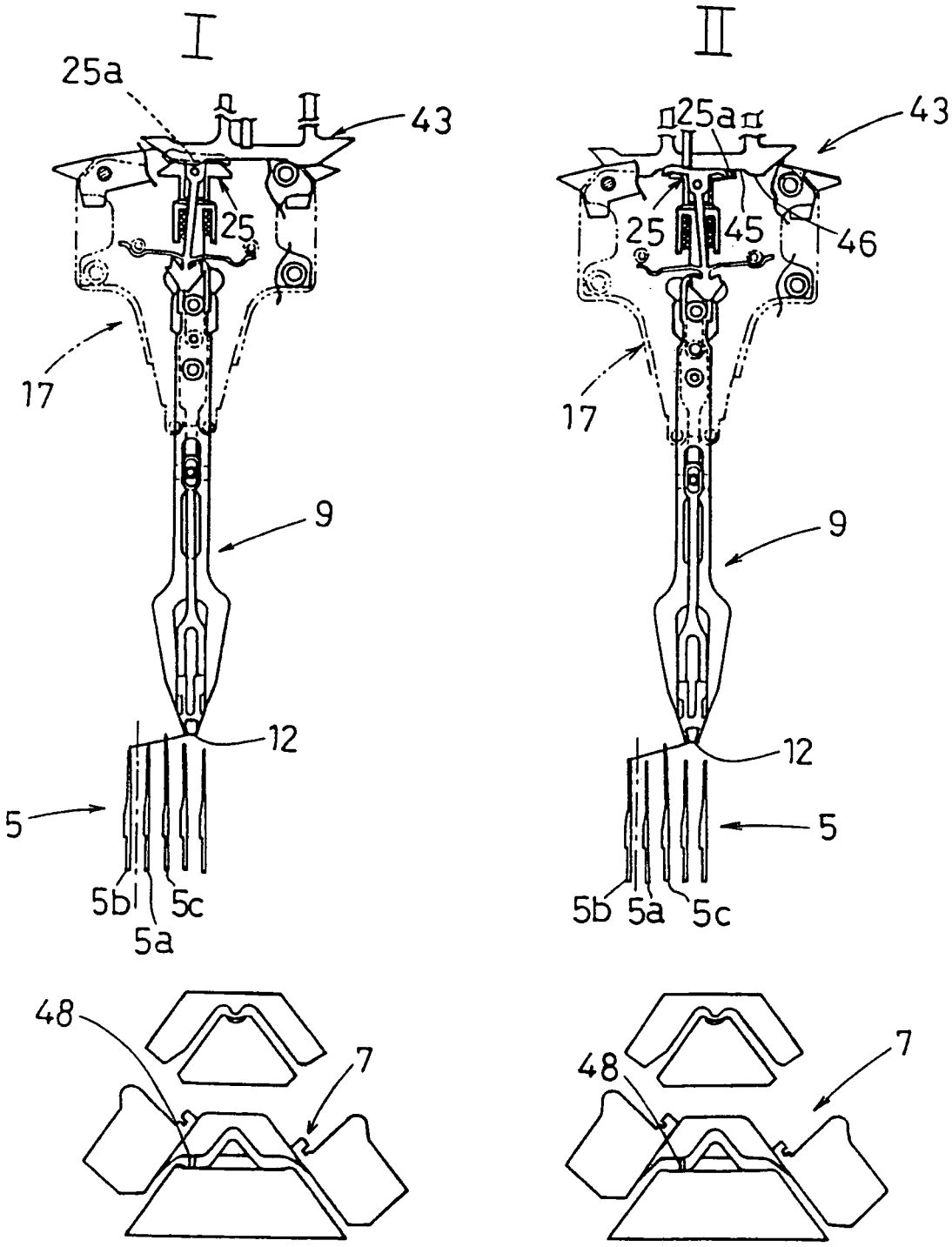
FIG. 10 is an operation explanatory drawing of the tuck joint in the yarn feeder of the present invention.
Figure 11:
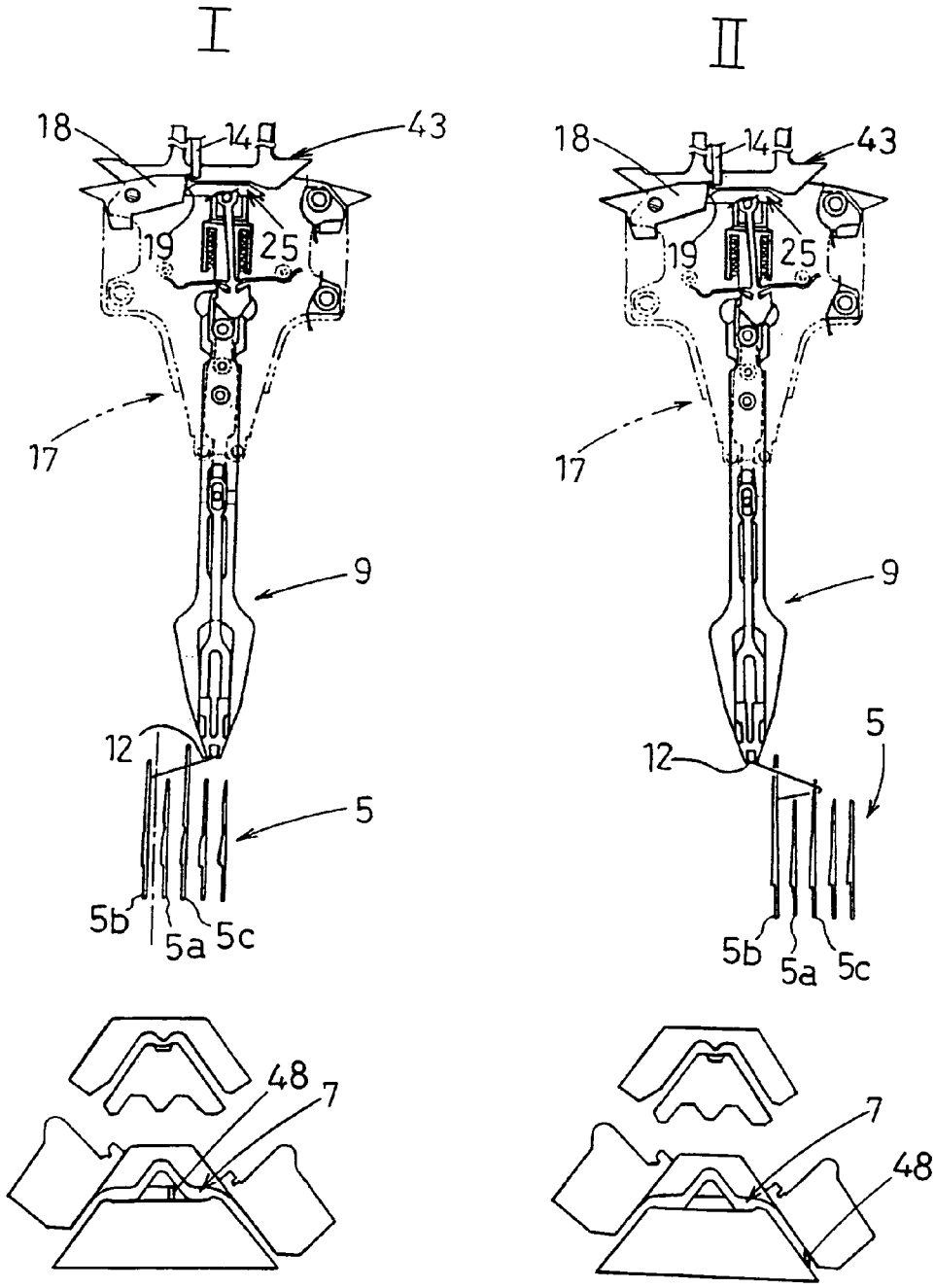
FIG. 11 is an operation explanatory drawing of the tuck joint in the yarn feeder of the present invention.

After the leading pin 14 is lowered, a fabric is knitted with a knitting yarn fed from the yarn feeding mouth 12 of a yarn feeder 9 selected by the same procedure as above. Referring to FIG. 9 through FIG. 11, a description will be given of a tuck joint performed by the knitting area B when switching and selection is performed between the yarn feeder for the knitting area A and the yarn feeder for the knitting area B.

FIG. 9 through FIG. 11 correspond to FIG. 3, showing the needle-advancing-and-retracting cam 7 serving to advance and retract needles and the butt of the knitting needle 5*c* serving to perform a tucking operation at the lower parts of the drawings.

As shown in I of FIG. 9, the yarn feeding mouth 12 of a selected yarn feeder 9 is in the state of having been swung on the side of a knitting area that is knitted by the yarn feeder 9. As shown in II of FIG. 9, when the upper end 25*a* of the upper plate 25 is lowered at the inclined part of the end of the cam plate 43 against an urging force of the coil spring 27, the switching roller 30 facing the restriction hole 31 descends while being guided by the lower center part of the restriction hole 31 and is erected.

After the leading pin 14 is lowered, a fabric is knitted with a knitting yarn fed from the yarn feeding mouth 12 of a yarn feeder 9 selected by the same procedure as above. A description will be given of a tuck joint performed by another yarn feeder 9 when this yarn feeder 9 is selected by switching.

As shown in I of FIG. 9, the yarn feeding mouth 12 of a selected yarn feeder 9 is in the state of having been swung on the side of a knitting area that is knitted by the yarn feeder 9. As shown in II of FIG. 9, when the upper end 25*a* of the upper plate 25 is lowered at the inclined part of the end of the cam plate 43 against an urging force of the coil spring 27, the switching roller 30 facing the restriction hole 31 descends while being guided by the lower center part of the restriction hole 31.

When the upper end 25*a* of the upper plate 25 is depressed by the tucking cam surface 46 of the cam plate 43 in response to the leftward sliding of the carriage 6, the yarn feeding mouth 12 descends to a descent position Y for a tuck that is below the yarn feeding position X as shown in FIG. 3 and in I of FIG. 10, and, accordingly, the height of a knitting yarn guided from the yarn feeding mouth 12 is lowered.

The upper end 25*a* of the upper plate 25 is depressed by the cam surface 46 of the cam plate 43 in response to the leftward sliding of the carriage 6, and the yarn feeder is changed from the swinging state to the erected state. After that, since the yarn feeding mouth 12 descends from the standby position Z to the descent position Y that is below the yarn feeding position X as shown in FIG. 3, the height of a knitting yarn guided from the yarn feeding mouth 12 is lowered.

The height of the knitting yarn guided from the yarn feeding mouth 12 is lowered in this way, and the butt 48 of the needle 5 in the adjoining knitting area B that is selected by a needle selecting device, not shown, is then advanced by the knitting cam 7. The knitting yarn reaches the state of passing under the knitted loop by the advancement of the needle 5.

When the upper end 25*a* of the upper plate 25 is moved from the cam surface 46 of the cam plate 43 to the cam surface 45 used for the yarn feeding position in response to the further leftward sliding of the carriage 6, the yarn feeding mouth 12 is raised to the yarn feeding position X. After that, when the leading pin 14 is engaged with the engagement portion 19 formed in the swing piece 18 as shown in I of FIG. 11, the yarn feeder 9 used to knit the knitting area B is led, and starts traveling leftward. Responding to the further leftward movement of the carriage 6, the knitting yarn passes through the surface side of the needle from the right side of the needle 5*c*, and is fed to a needle 5*c* as shown in II of FIG. 11, so that the fabric is knitted by the tucking.

The loop lastly formed in the previous course is pulled down by a fabric-rolling-down device, and a knitting yarn stretched from the loop lastly formed to the yarn feeding mouth 12 extends from below the trick gap of the needle to the yarn feeding mouth. Therefore, the descent position is not necessarily required to be set so that the tip of the yarn feeding mouth becomes below a rising locus of the needle, and what is needed is to set the yarn at a position where the yarn can pass under the backface of the needle.

INDUSTRIAL APPLICABILITY

As described above, the present invention is formed such that when a yarn feeder that can be selectively led by a leading means and that is being led is released from being led, and switching is performed from a yarn feeding position to a standby position; until a yarn feeder selected to switch a knitting yarn to another is caused to feed a yarn and is traveled from the standby position where the yarn feeder is stopped, a yarn feeding mouth is then lowered to a tucking descent position placed below the yarn feeding position in a state in which the yarn feeder is stopped, and an outer knitting needle adjoining to a knitting area knitted by the selected yarn feeder is advanced; a knitting yarn fed from the yarn feeding mouth of the yarn feeder occupying the tucking descent position is caused to pass under an undersurface of the advanced knitting needle; and the yarn feeder is raised, and, with the yarn feeding mouth as a yarn feeding position, the selected yarn feeder is caused to feed a knitting yarn and is traveled by the leading means.

As described above, according to the present invention, the needle starts rising when the yarn feeder is lowered from the standby position to the descent position below a yarn feeding position, and the yarn is allowed to pass under the backface side of the needle and is then raised to the yarn feeding position, and a tucking operation is performed while feeding the yarn. Therefore, according to the present invention, the same effect as in a case in which a swing stroke of the yarn feeder is enlarged can be obtained without enlarging the swing stroke thereof. Therefore, a tuck joint can be reliably performed by allowing the yarn to pass under the backface side of the needle.

Since the yarn feeder can be prevented from being made large in size, an increase in weight does not occur. Therefore, advantageously, even when the leading means leads the yarn feeder at high speed, a shock caused when being led is slight, and durability can be improved without requiring the reinforcement of the entire device.

Moreover, when the yarn feeding mouth is changed from the yarn feeding position to the standby position placed inside the knitted area, the amount of swing needed to switch from the yarn feeding position to the standby position never increases even when a knitted fabric is formed by a rough gauge or by the needle-jumping-over knitting operation. Hence, advantageously, a knitting yarn does not snap even if the yarn is fragile, and fabric boundary parts can be reliably joined together by a tucking operation when the knitting yarn is switched to another.

What is claimed is:

1. A yarn feeding device of a flat knitting machine including:

a feeder case a part of which is slidably engaged with a yarn guide rail disposed on an upper part of a needle bed; and a slide driving mechanism by which a yarn feeder selected from among a plurality of yarn feeders by a leading means is led, wherein the feeder case includes a switching mechanism for switching a position of a yarn feeding mouth to another and swinging the yarn feeder; the switching mechanism includes a push operating portion for changing a swing direction of the yarn feeding mouth and a height position thereof in cooperation with the leading means; and the push operating portion forms a lowering surface used to further lower the yarn feeding mouth from a yarn feeding position in a surface of the push operating portion, and, until the yarn feeder selected by the leading means feeds a yarn and is led from a stopped state, the yarn feeding mouth is lowered from a standby position to a descent position and is raised to the yarn feeding position after a knitting yarn is allowed to pass under a backface side of a knitting needle.

2. A yarn feeding method of a flat knitting machine, wherein a feeder case part is slidably engaged with a yarn guide rail disposed on an upper part of a needle bed and is selectively led by a leading means; until a yarn feeder selected to switch a knitting yarn to another is allowed to feed a yarn and is traveled from a standby position where the yarn feeder is stopped, a yarn feeding mouth is swung from the standby position to a yarn feeding position in a state of stopping the yarn feeder and is then lowered to a descent position for a tuck placed below the yarn feeding position; by advancing an outer knitting needle adjoining to a knitting area knitted by the selected yarn feeder, a knitting yarn fed from the yarn feeding mouth of the yarn feeder occupying the descent position is allowed to pass under an undersurface of the advanced knitting needle; and the yarn feeder is then raised, and, with the yarn feeding mouth as a yarn feeding position, the selected yarn feeder is allowed to feed a knitting yarn and is traveled with a slide driving means by the leading means.

* * * * *